US008892236B2

(12) United States Patent
Olsen

(10) Patent No.: US 8,892,236 B2
(45) Date of Patent: Nov. 18, 2014

(54) METHOD AND APPARATUS FOR ETCHING PLURAL DEPTHS WITH A FLUID JET

(75) Inventor: Carl C. Olsen, Vashon, WA (US)

(73) Assignee: OMAX Corporation, Kent, WA (US)

( * ) Notice: Subject to any disclaimer, the term of this patent is extended or adjusted under 35 U.S.C. 154(b) by 551 days.

(21) Appl. No.: 12/486,613

(22) Filed: Jun. 17, 2009

(65) Prior Publication Data

US 2009/0311944 A1 Dec. 17, 2009

Related U.S. Application Data

(60) Provisional application No. 61/132,428, filed on Jun. 17, 2008.

(51) Int. Cl.

| | |
|---|---|
| ***G06F 19/00*** | (2011.01) |
| ***B24C 1/04*** | (2006.01) |
| ***B24C 1/00*** | (2006.01) |

(52) U.S. Cl.

CPC .... *B24C 1/00* (2013.01); *B24C 1/04* (2013.01)
USPC ..... 700/118; 700/160; 451/2; 451/5; 451/38

(58) Field of Classification Search

USPC ..... 700/118, 160
See application file for complete search history.

(56) References Cited

U.S. PATENT DOCUMENTS

| | | | | |
|---|---|---|---|---|
| 5,508,596 | A | 4/1996 | Olsen | |
| 5,704,824 | A | 1/1998 | Hashish et al. | |
| 5,778,713 | A * | 7/1998 | Butler et al. | 72/53 |
| 5,782,673 | A * | 7/1998 | Warehime | 451/2 |
| 6,126,524 | A | 10/2000 | Shepherd | |
| 6,247,422 | B1 | 6/2001 | Murray, III | |
| 6,283,832 | B1 | 9/2001 | Shepherd | |
| D470,566 | S | 2/2003 | Sciulli et al. | |
| 7,216,003 | B2 * | 5/2007 | Faulkner et al. | 700/26 |
| 7,419,418 | B2 | 9/2008 | Alberts et al. | |
| 7,489,984 | B2 * | 2/2009 | Jackman et al. | 700/183 |
| 7,585,201 | B2 | 9/2009 | Kanai et al. | |
| 2006/0278613 | A1 * | 12/2006 | Hess | 216/83 |
| 2008/0033593 | A1 * | 2/2008 | Dufort | 700/197 |
| 2009/0124169 | A1 | 5/2009 | Alberts et al. | |
| 2012/0309268 | A1 * | 12/2012 | Summers et al. | 451/40 |

OTHER PUBLICATIONS

KERN Laser Systems, "3D Laser Engraving System", http://www.kernlasers.com/3d_laser_engraving.htm , downloaded on Oct. 5, 2010.

"Custom Fabricator PIW Corporation Couples "Tool Box" of Innovation, High Tech Equipment and Craftsmanship With Swat Team Approach", Waterjet Success Stories, PIW Corp.—Homer Glen, Illinoishttp://jetedge.com/content.cfm?fuseaction=dsp_success_case&case_ID=93.

Epilog Laser 2009; Zing Laser 3D Engraving; http://www.epiloglaser.com/zing_3d_engraving.htm.

* cited by examiner

*Primary Examiner* — Ryan Jarrett

(74) *Attorney, Agent, or Firm* — Perkins Coie LLP

(57) ABSTRACT

A fluid jet system is configured to etch a workpiece to a plurality of depths to produce an etched part corresponding to a computer image.

40 Claims, 15 Drawing Sheets

112
114
202
103
$v_1$
$d_1$ 112
114
202
103
$v_2$
$d_2$ 112
114
202
103
$v_3$
$d_3$

1202

METHOD AND APPARATUS FOR ETCHING PLURAL DEPTHS WITH A FLUID JET

CROSS REFERENCE TO RELATED APPLICATIONS

This application claims priority benefit under 35 U.S.C. §119(e) from, and to the extent not inconsistent with this application, incorporates by reference herein U.S. Provisional Patent Application Ser. No. 61/132,428; filed Jun. 17, 2008; entitled "ETCHING WITH A FLUID JET USING MULTIDIMENSIONAL DATA SET INPUTS"; invented by Carl C. Olsen.

SUMMARY

According to an embodiment, a fluid jet system includes at least one nozzle configured to emit at least one fluid jet toward a workpiece, a position actuator configured to move the nozzle across the workpiece, and a controller including a ablation depth driver, the ablation depth driver being configured to modulate a penetration depth of the fluid jet into the workpiece. For example the ablation depth driver may be configured to modulate the speed at which the position actuator moves the nozzle across the workpiece, wherein slower speeds provide relatively more etch depth and faster speeds provide relatively less etch depth. The fluid jet system may be used to produce parts with variable etch depths bearing images.

According to an embodiment, a fluid jet system includes at least one nozzle configured to emit at least one fluid jet toward a workpiece, a position actuator configured to move the nozzle across the workpiece, and a controller including a ablation depth driver, the ablation depth driver being configured to modulate a penetration depth of the fluid jet into the workpiece by driving one or more actuators configured to modulate at least one of a fluid jet nozzle scan speed, a fluid jet nozzle distance from a workpiece surface, a fluid jet shape, a fluid jet diameter, an amount of abrasive in a fluid jet, a fluid pressure delivered to at least one fluid jet nozzle, selection of two or more fluid jet nozzles, and a fluid jet angle relative to the workpiece surface.

According to an embodiment, a tangible computer-readable medium includes computer instructions configured to provide a digital image and convert the image to tool commands selected to drive a fluid jet system to produce an etched part etched in a pattern at least partially corresponding to the image. The tool commands are selected to modulate a fluid jet ablation depth into a workpiece. According to an embodiment the tool commands may include at least one of a fluid jet nozzle scan speed, a fluid jet nozzle distance from a workpiece surface, a fluid jet shape, a fluid jet diameter, an amount of abrasive in a fluid jet, a fluid pressure delivered to at least one fluid jet nozzle, selection of two or more fluid jet nozzles, and a fluid jet angle relative to the workpiece surface as a function of the digital image. According to an embodiment, the tool commands may be based on at least one of image grayscale or image color information.

According to an embodiment, a method for producing an etched part includes receiving computer image data, converting the computer image data to tool commands; and driving a fluid jet system with the tool commands to produce an etched part including an etched pattern corresponding to the received computer image data, the etched pattern including a least two different material removal depths. According to an embodiment the tool commands may include at least one of a fluid jet nozzle scan speed, a fluid jet nozzle distance from a workpiece surface, a fluid jet shape, a fluid jet diameter, an amount of abrasive in a fluid jet, a fluid pressure delivered to at least one fluid jet nozzle, two or more fluid jet nozzles, and a fluid jet angle relative to the workpiece surface as a function of the computer image data.

DETAILED DESCRIPTION

Figure 1:
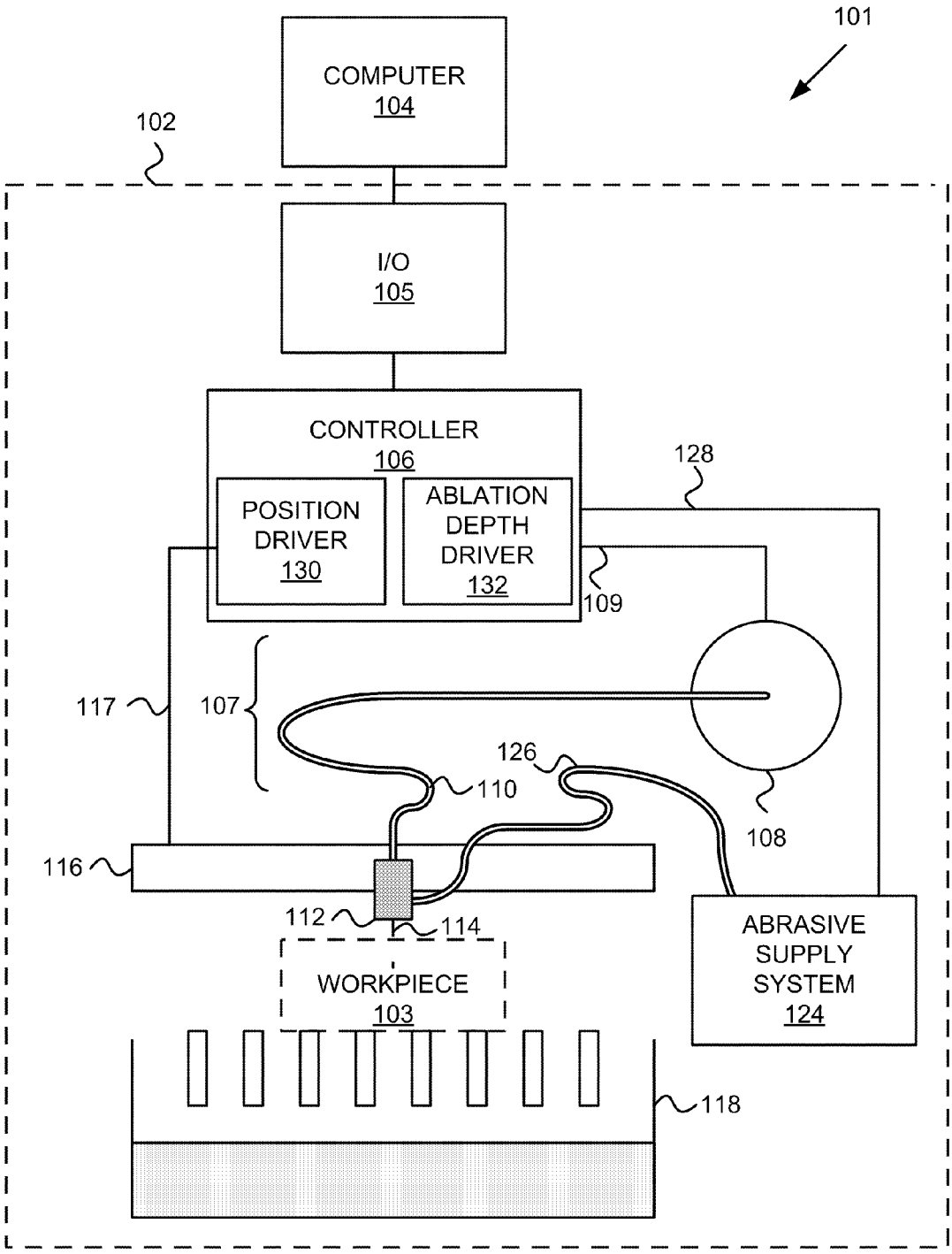
FIG. 1 is a diagram illustrating a fluid jet cutting system configured to remove a plurality of depths of material from a workpiece, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is a diagram illustrating a fluid jet cutting system 101 including a fluid jet apparatus 102 configured to etch and/or cut a workpiece 103, according to an embodiment. A computer 104 may be configured to provide data corresponding to a cutting path for the workpiece 103, wherein the data includes data corresponding to a plurality of cutting depths. The fluid jet apparatus 102 may include a controller 106 configured to receive data from the computer 104 via an interface 105.

The controller 106 may be operatively coupled to a high pressure fluid delivery system 107 via a signal transmission path 109. The fluid delivery system 107 is configured to provide high pressure fluid from the fluid pump 108 through high pressure tubing 110 to at least one nozzle 112. The nozzle 112 receives the high pressure fluid and projects a high velocity fluid jet 114. According to an embodiment, the depth of penetration of the fluid jet 114 into the workpiece 103 may be modulated by transmitting tool commands from the controller 106 via the signal transmission path 109 to the fluid delivery system 107, the tool commands being selected to control the pressure of fluid delivered to the at least one nozzle 112.

The controller 106 is operatively coupled to drive a position actuation system 116 configured to drive the position of the nozzle 112 via a position actuation interface 117. Typically, position actuation systems 116 include at least X-Y drive. Some actuation systems additionally include Z-axis and tilt drive. The controller 106 drives the actuation system 116 by sending tool commands via the signal transmission path 117 to position the nozzle 112 to scan the fluid jet 114 across the workpiece 102 to make cuts. According to embodiments, the tool commands may also control one or more of nozzle velocity, distance, or tilt to determine the penetration depth of the fluid jet 114. The workpiece 103 is supported by a workpiece support system 118.

The actuation system 116 may include a variety of motion mechanisms and/or may be used in other motion systems. For example, the actuation system 116 may include a friction drive, a belt drive, a chain drive, a cable drive, a rack and pinion drive, a lead screw or ball screw drive, a rolling ring drive, and/or a linear drive. The actuation system 116 may include different drive mechanisms in different axes.

While references herein refer to scanning at least one nozzle 112 across a workpiece 103, is shall be understood that such references also include embodiments where the workpiece 103 is scanned past a nozzle 112. Hence, scanning or moving at least one nozzle relative to a workpiece also means scanning or moving a workpiece relative to at least one nozzle. To scan or move a workpiece past a nozzle, typically a workpiece support system 118 may be operatively coupled to at least one actuator 116. Optionally, scanning a workpiece past a nozzle (and hence, scanning a nozzle across a workpiece) may include rotating a workpiece. Rotating a workpiece may occur in multiple axes, and particularly may include rotating a cylindrical object. Rotating a cylindrical workpiece relative to a nozzle may be used to etch an image partly or completely around the circumference of the cylindrical object. Where the material surface is cylindrical or spherical (or both), it may be advantageous to use a jet tool where the jet may be tilted based on tool commands so the jet can be adjusted to impinge at an angle perpendicular to the original surface at all points. If the material to be etched is a rod or cylinder, it may be mounted in a rotatable chuck that is also controlled by the tool commands so that full-round sculptures may be created.

An abrasive supply system 124 may provide abrasive particles such as garnet to the at least one nozzle 112 through an abrasive supply tube 126, and particularly to a mixing tube (not shown), where the abrasive particles may be entrained in the high velocity jet 114. The controller 106 may be operatively coupled to the abrasive supply system 124 by least one signal transmission path 128. Tool commands sent by the controller 106 to the abrasive supply system 124 via the signal transmission path 128 may be configured to control the amount of abrasive delivered to the at least one nozzle 112. The amount of abrasive delivered to the nozzle 112 may, in turn, determine the amount of abrasive entrained in the fluid jet 114. This may be used to control the depth of jet penetration into the workpiece 103.

According to an embodiment, the at least one nozzle 112 may include an actuation mechanism (not shown) to control the shape of the fluid jet 114. For example, the at least one nozzle 112 may include a multi-plate orifice configured to modify jet diameter, the multi-plate orifice being operatively coupled to the controller 106 via a nozzle actuation signal transmission path (not shown). Typically, a smaller diameter jet 114 may penetrate deeper into a workpiece 103 and a larger diameter jet 114 may penetrate less deeply into the workpiece 103.

According to an embodiment, the nozzle 112 may include a plurality of nozzles 112. Tool commands may be transmitted from the controller 106 via at least one signal transmission path (not shown) to the plurality of nozzles 112 to select between the plurality of nozzles 112. For example, a first nozzle may be configured to penetrate a first depth into the workpiece 103 and a second nozzle may be configured to penetrate to a second depth different than the first depth.

The controller 106 may include a position driver 130 configured to drive one or more position actuators 116. For example the position driver 130 may be configured to receive movement commands, determine velocity from the movement commands, output motor control signals to a stepper motor or servo motor, monitor a position sensor, and adjust the motor control signals responsive to feedback from the position sensor.

The controller 106 may include an ablation depth driver 132 configured to control a depth of penetration by at least one fluid jet 114 emitted from at least one nozzle 112. As indicated briefly above, various actuation mechanisms may be used to modulate ablation depth. According to various embodiments, the ablation depth driver 132 may be operatively coupled to various depth modulation actuators. Actuation of one or more depth modulation actuators may be made synchronously with movements driven by the position driver 130. According to embodiments where the ablation depth modulation includes driving actuators other than one or more position actuators 116, the ablation depth driver 132 may be operatively coupled to receive a signal or data from the position driver 130 indicative of position. The ablation depth driver 132 may responsively actuate an ablation depth actuator to selectively erode the workpiece to a desired depth.

According to an embodiment, ablation depth may alternatively or additionally be modulated by modulating a speed of translation of at least one nozzle 112 across the workpiece 103. The ablation depth driver 132 may accordingly be operatively coupled to the position driver 130 to provide a signal or data indicative of the desired velocity to achieve a desired ablation depth. For example, the ablation depth driver 132 may control a timing of position commands sent to the position driver 130. The position driver 130 may calculate motor speed as a function of the timing of received position commands. The position driver 130 may output motor step commands at a rate corresponding to the calculated speed.

According to an embodiment, the ablation depth driver 132 may include at least one of software, firmware, and computer instructions configured to provide an output signal or data to control an ablation depth of the fluid jet 114 into the workpiece 103. For example, the ablation depth driver 132 may include tool instructions held in a memory circuit, the tool instructions including a plurality of tool path commands including a plurality of nozzle 112 scan speeds corresponding to respective etch depths. According to an embodiment, the ablation depth driver 132 may include electrical circuitry configured to output a control signal corresponding to an ablation depth. For example, the ablation depth driver 132 may include tool instructions held in a memory circuit, a circuit to receive a nozzle 112 position, logic to output the tool instructions responsive to the nozzle 112 position, and a digital-to-analog converter (DAC) and amplifier configured to provide a control signal to an actuator corresponding to the tool instructions. For example, the DAC and amplifier may send a control signal to a position actuator, a Z-axis actuator, a nozzle 112 orifice actuator, an abrasive valve, a pressure valve, a pump controller, or a nozzle 112 selector valve, as will become evident from information presented below.

The data corresponding to a cutting path for the workpiece 103 including data corresponding to a plurality of cutting depths is output from the computer 104 to the controller 106 via the data interface 105. According to an embodiment, the computer may include a program configured to select at least relative depths as a function of at least one of grayscale levels or colors in an image. According to an embodiment, the computer may be configured to convert the image into tool commands. The controller 106 may be configured to receive the tool commands via the data interface 105.

According to another embodiment, the computer 104 may be configured to transmit an image to the controller 106 through the data interface 105. The controller 106 may be configured to convert the image into tool commands. The ablation depth driver 132 may be configured to modulate fluid jet penetration depth corresponding to the image. The controller 106 may be configured to select at least relative depths as a function of at least one of grayscale levels or colors in the image. The ablation depth driver 132 may be configured to drive the penetration depth of the fluid jet 114 into the workpiece 103 corresponding to the at least relative depths.

The ablation depth driver 132 may be configured to dynamically modulate the penetration depth of the fluid jet 114 into the workpiece 103 synchronously with movement of the at least one nozzle 112 across the workpiece 103.

Figures 2A, 2B, 2C:
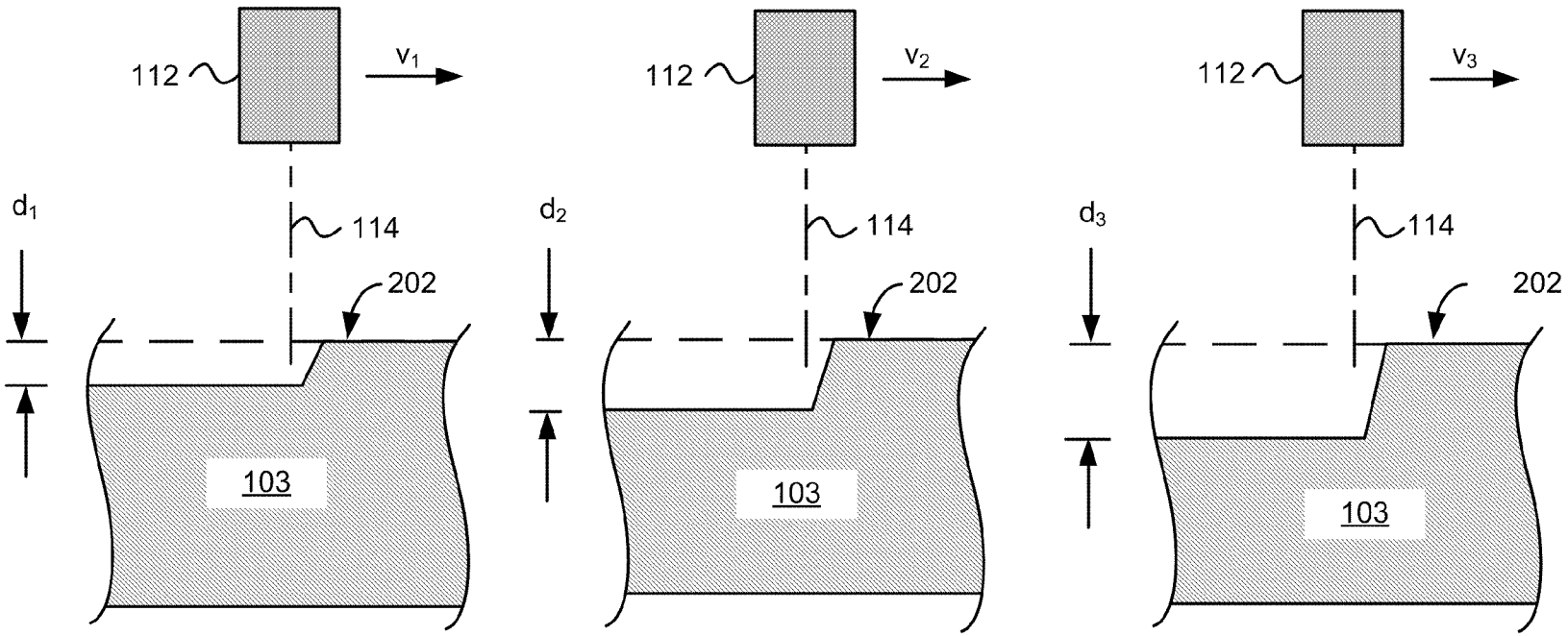
FIG. 2A is a depiction of a fluid jet nozzle scanning across a workpiece at a first velocity $v_1$ selected to remove material to a first depth $d_1$, according to an embodiment.
FIG. 2B is a depiction of a fluid jet nozzle scanning across a workpiece at a second velocity $v_2$ selected to remove material to a second depth $d_2$, according to an embodiment.
FIG. 2C is a depiction of a fluid jet nozzle scanning across a workpiece at a third velocity $V_3$ selected to remove material to a third depth $d_3$, according to an embodiment.

As described above, the fluid jet system 101 and the fluid jet apparatus 102 may be configured to modulate an etch depth into the workpiece 103 by modulating the speed at which at least one nozzle 112 is scanned across the workpiece 103. FIGS. 2A-2C illustrate controlled removal of a depth of material as a function of nozzle speed. FIG. 2A is a depiction of a fluid jet nozzle 112 scanning across a workpiece 103 at a first speed $v_1$ selected such that the fluid jet 114 removes material to a first depth $d_1$, below the surface 202 of the workpiece 103, according to an embodiment. The first speed $v_1$ may be a relatively high speed and the first depth $d_1$ may be a relatively shallow depth.

FIG. 2A is a depiction of a fluid jet nozzle 112 scanning across a workpiece 103 at a second speed $v_2$ selected such that the fluid jet 114 removes material to a second depth $d_2$ below the surface 202 of the workpiece 103, according to an embodiment. The second speed $v_2$ may be a medium speed and the second depth $d_2$ may be a medium depth. FIG. 2C is a depiction of a fluid jet nozzle 112 scanning across a workpiece 103 at a third speed $V_3$ selected such that the fluid jet 114 removes material to a third depth $d_3$ below the surface 202 of the workpiece 103, according to an embodiment. The third speed $V_3$ may be a relatively low speed and the third depth $d_3$ may be a relatively large depth.

Accordingly, the nozzle 112 may be driven at a relatively high velocity or speed at locations of a scan pattern corresponding to relatively little ablation of the workpiece and at a relatively low velocity or speed at locations of a scan pattern corresponding to relatively large ablation of the workpiece. According to an embodiment, the relatively high scanning speed $v_1$ may be about 25 inches per minute. According to an embodiment, the relatively low scanning speed $v_3$ may be about 2 inches per minute.

According to an embodiment, at least one nozzle 112 may be dynamically driven at different velocities relative to the workpiece 103. For example, as may be appreciated with reference to FIG. 10, the nozzle 112 or the workpiece 103, movement path may traverse variable etch depths in a given portion of a scan path, and hence the velocity may be dynamically changed to etch a pattern that varies in depth along the scan path. According to another embodiment, a scan pattern may be selected to proceed along a topographical path wherein a substantially constant etch depth is maintained, and then proceed along another topographical path where another substantially constant etch depth is maintained. Such a topographical path may include a vector path.

Figure 3:
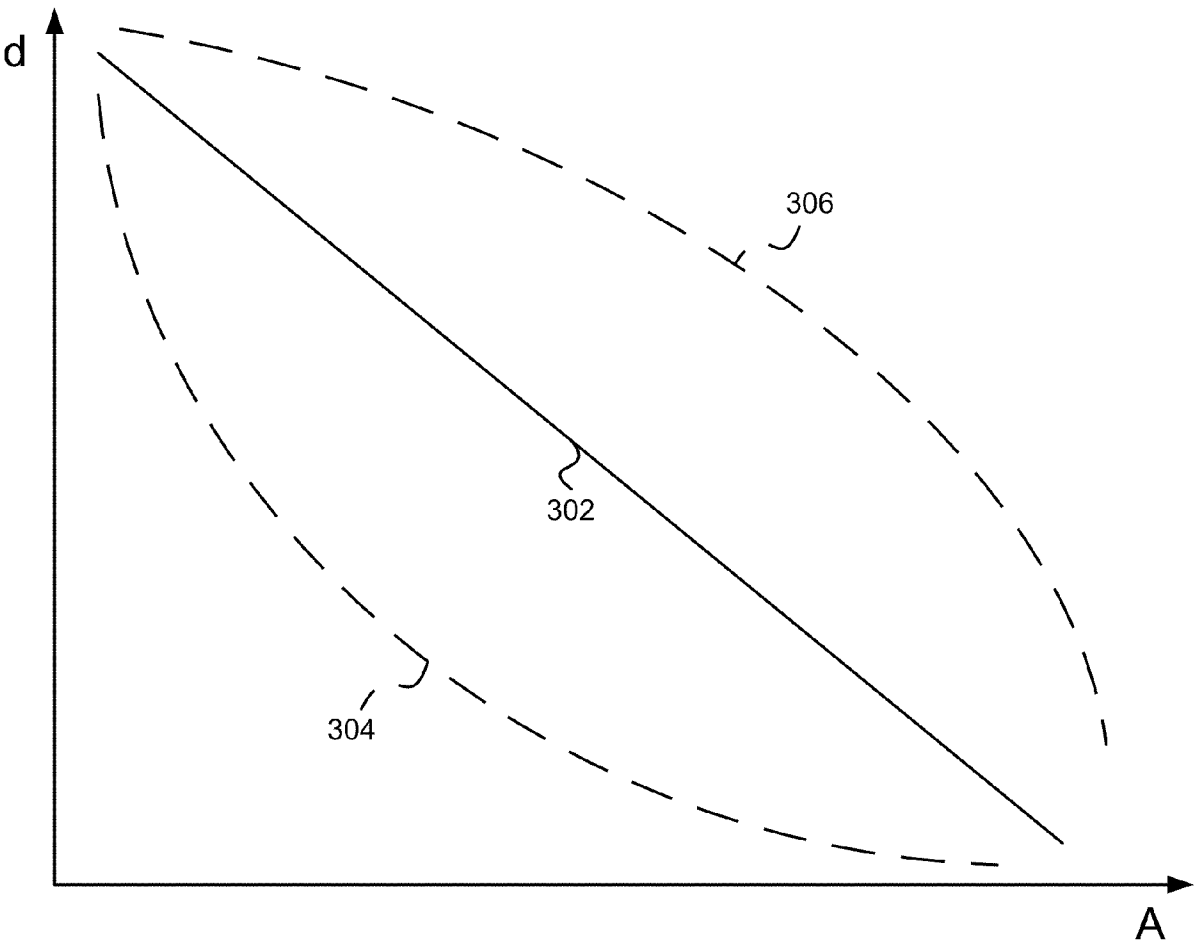
FIG. 3 is a graph showing some idealized relationships between a control parameter A and depth d, according to an embodiment.

FIG. 3 is a graph showing some idealized relationships between a control parameter A and depth d, according to an embodiment. For example, FIGS. 2A, 2B, and 2C illustrate various material removal depths where the control variable A is nozzle/workpiece scanning speed. As described above, for the example of FIG. 3 small values of A correspond to relatively low speed and large values of A correspond to relatively high speed. As may be appreciated from inspection of FIG. 3, the relationship between a control variable A and material removal depth d need not be linear. Curve 302 illustrates an embodiment where the relationship between the control variable A and the depth of material removed d is linear. Curve 304 illustrates an embodiment where changes between relatively low values of A result in relatively large changes in ablation depth and changes between relatively high values of A result in relatively small changes in ablation depth. Curve 306 illustrates an embodiment where changes between relatively low values of A result in relatively small changes in ablation depth and changes between relatively high values of A result in relatively large changes in ablation depth.

The slope of the relationship between one or more control variables A and ablation depth may be negative, positive, or may pass through one or more minima or maxima. Most commonly, curves 302, 304, or 306 may monotonically increase or monotonically decrease. The shape of the relationship between a control variable A and etch depth d 302, 304, 306 may be accounted for during image conversion, described below. The image converter may derive a control variable A value from an image attribute (typically on a pixel-by-pixel or a pixel block basis) such as grayscale value or color using an algorithm and/or look-up table to determine a control variable A as a function of desired d. The image converter may be resident in the computer 104 and/or the controller 106 of the system 101 shown in FIG. 1. According to one embodiment, the image converter may be partially resident in both the computer 104 and the controller 106. For example, the computer 104 may convert an image such as a two-dimensional image to corresponding depths d. The controller may receive an array of depths and convert the depths to corresponding tool commands using a relationship 302, 304, 306.

According to embodiments, a plurality of relationships 302, 304, 306 between depth and the control variable A may be established as a function of workpiece material properties, machine settings, etc. For example, a curve 302, 304, 306 for a workpiece made of mild steel may be different than a curve 302, 304, 306 for a workpiece made of brass.

Figure 4:
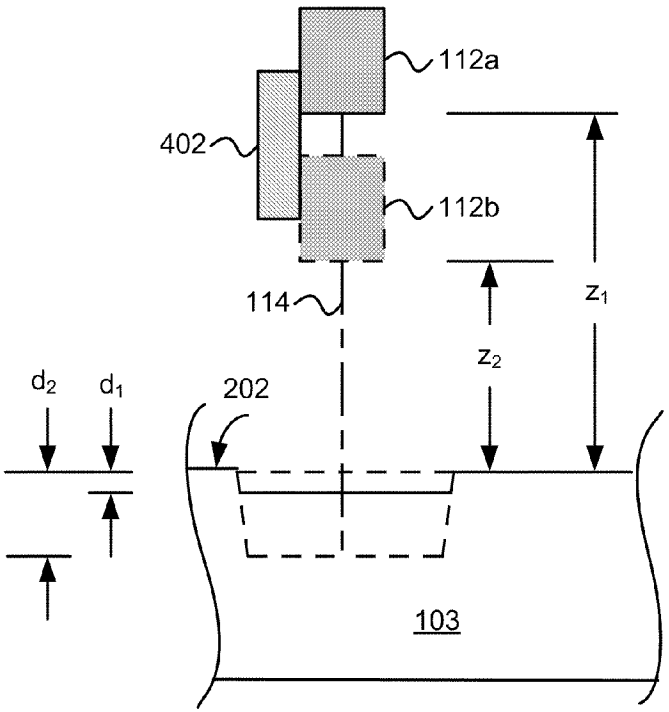
FIG. 4 is a diagram showing a fluid jet system configured to vary material removal depth d as a function of a control variable including a distance z between the workpiece and the at least one nozzle, according to an embodiment.

As described above, various mechanisms may be used to control ablation depth. FIG. 4 is a diagram showing a fluid jet system configured to vary material removal depth d as a function of a control variable A including a distance z between the workpiece 101 and the nozzle 112. A Z-axis actuator 402 may be configured to move the at least one nozzle 112 to a plurality of distances from a surface 202 of the workpiece 103. A first nozzle position 112*a* corresponds to a relatively large distance $z_1$ from the workpiece surface 202 selected to produce a relatively shallow etch depth $d_1$ into the workpiece 103. A second nozzle position 112*b* corresponds to a relatively small distance $z_2$ from the workpiece surface 202 selected to produce a relatively large etch depth $d_2$ into the workpiece. The ablation depth driver 132 may include a Z-axis actuator driver circuit configured to modulate the z-axis actuator 402 to vary the distance of the at least one nozzle 112 from the surface 202 of the workpiece 103.

In FIG. 4 and others illustrating depth modulation mechanisms, the illustrated width of an etched area around a fluid jet 114 is not intended to depict a material removal width. Rather, it shall be understood that material ablated by the jet 114 during any given instant may substantially be limited to the impact site of the fluid jet 114 on the workpiece 103. The position of impact may change substantially continuously as the nozzle 112 is moved across the workpiece 103. The width of diagrammatically illustrated material ablation areas is included help the reader see the various depths of material removed responsive to ablation depth modulation embodiments.

Figure 5:
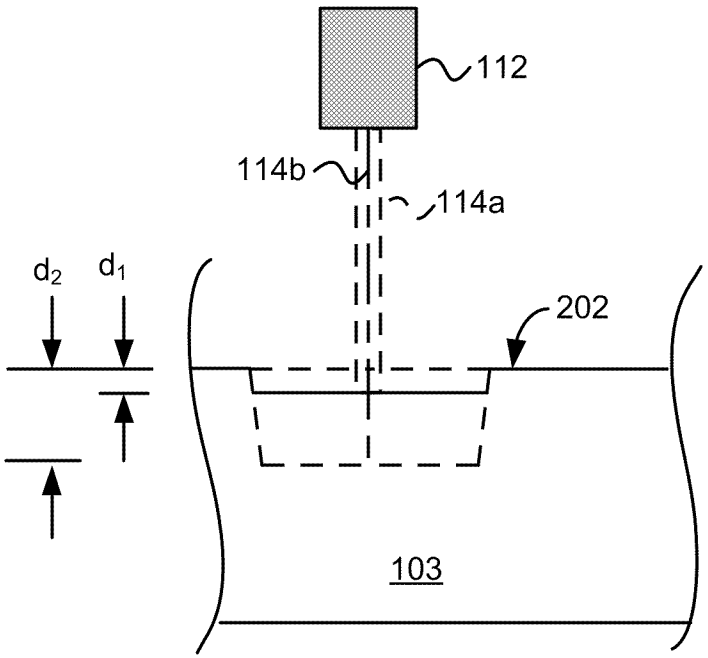
FIG. 5 is a diagram showing a fluid jet system configured to vary material removal depth d as a function of a control variable including a jet pattern or diameter impinging upon the workpiece, according to an embodiment.

FIG. 5 is a diagram showing a fluid jet system configured to vary material removal depth d as a function of a control variable including a jet pattern or diameter impinging upon the workpiece 103, according to an embodiment. At least one nozzle 112 includes a fluid jet diameter actuator configured to select a plurality of fluid jet diameters to impinge on the workpiece 103. For example the at least one nozzle 112 may be configured to project a first fluid jet 114*a* having a first diameter selected to provide material ablation to a first depth $d_1$ in the workpiece. The at least one nozzle 112 may be further configured to selectively project a second fluid jet 114*b* having a second diameter selected to provide material ablation to a second depth $d_2$ in the workpiece 103. Generally, a fluid jet 114*a* having a larger diameter may produce a relatively shallow material ablation depth $d_1$. A fluid jet 114*b* having a smaller diameter may produce material ablation to a relatively large depth $d_2$. Other things being equal, the larger diameter fluid jet 114*a* may have a lower velocity than a smaller diameter fluid jet 114*b*, thus producing less erosion or ablation from the workpiece 103 surface 202.

In the example of FIG. 5, the ablation depth driver 132 may be configured to modulate the diameter of the fluid jet 114 impinging on the workpiece 103. For example the ablation depth driver 132 may include a motor driver. The at least one nozzle 112 may include a multi-plate orifice configured to modify jet diameter. The multi-plate orifice may be driven to a plurality of cross-sectional areas by a stepper motor. The ablation depth driver 132 motor driver may be operatively coupled to the stepper motor configured to drive the variable cross-sectional area orifice in the at least one nozzle 112, thus modifying the fluid jet 114 shape and/or diameter.

Figure 6:
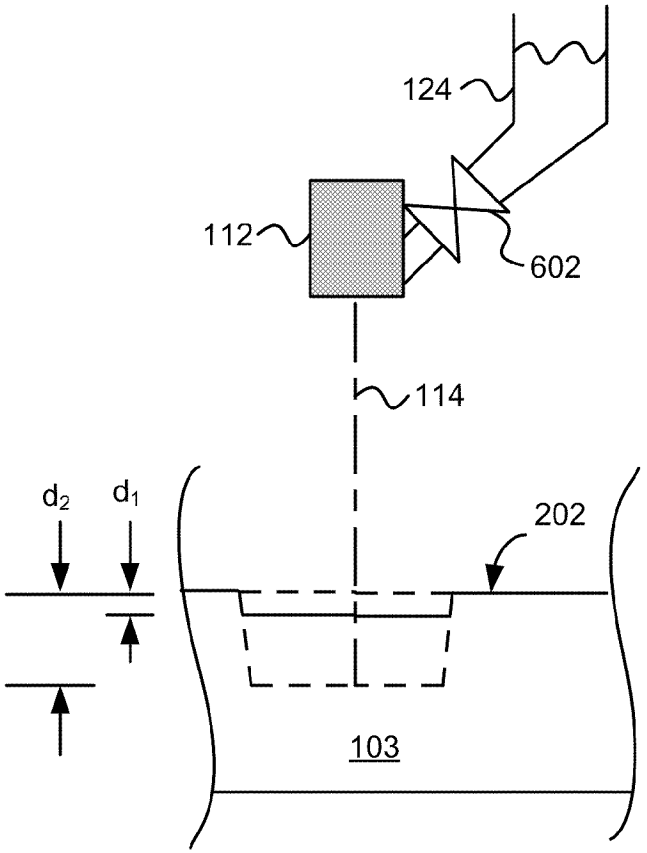
FIG. 6 is a diagram showing a fluid jet system configured to vary material removal depth d as a function of a control variable including an amount of abrasive in the fluid jet, according to an embodiment.

FIG. 6 is a diagram showing a fluid jet system configured to vary material removal depth d as a function of a control variable including an abrasive amount in the fluid jet 114. An abrasive supply system configured to provide abrasive to at least one nozzle 112 and a fluid jet 114 emitted therefrom. Typically, a fluid jet nozzle 112 configured to mix abrasive with the fluid jet includes an orifice that projects a fluid jet through a mixing tube (not shown). Abrasive particles such as garnet may be admitted to the mixing tube. The high velocity of the fluid jet may entrain the particles in the mixing tube and deliver the abrasive particles to the workpiece 103 at high velocity. A relatively small amount of abrasive in the fluid jet 114 may result in a relatively shallow depth of ablation $d_1$ from the surface 202 of the workpiece 103. A larger amount of abrasive in the fluid jet 114 may result in a relatively deep ablation depth $d_2$ from the surface 202 of the workpiece 103.

An abrasive valve 602 may be actuated by an ablation depth driver 132 including an abrasive flow actuator circuit configured to modulate an amount of abrasive entrained in the fluid jet 114. The abrasive valve 602 may include a slide valve, an abrasive supply angle actuator, a valve to an abrasive removal vacuum, a bladder valve, or other valve configured to control the abrasive particles. Alternatively, the mixing tube (not shown) may include an apparatus configured to selectively prevent entrainment of the abrasive in the fluid jet 114. For example, a variable shield at the abrasive inlet (not shown) or a variable vacuum abrasive removal channel (not shown) may selectively divert abrasive from the fluid jet 114.

Figure 7:
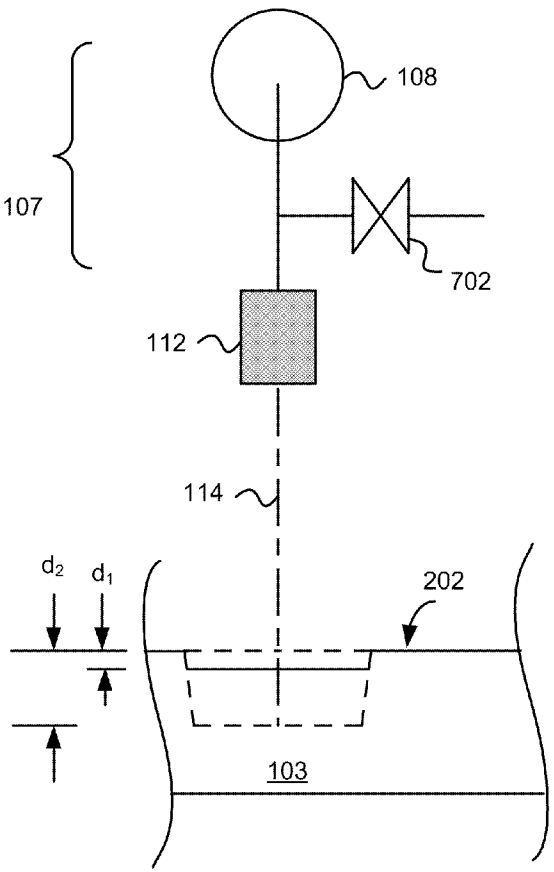
FIG. 7 is a diagram showing a fluid jet system configured to vary material removal depth d as a function of a control variable including a fluid pressure delivered to at least one nozzle, according to an embodiment.

FIG. 7 is a diagram 701 showing a fluid jet system configured to vary material removal depth d as a function of a control variable including a fluid pressure delivered to the at least one nozzle 112, according to an embodiment. A fluid delivery system 107 may include a pump 108 and optionally a bleed valve 702. The ablation depth driver 132 (FIG. 1) may include a pump control circuit configured to control the pump 108 to modulate the pressure of the fluid produced and delivered to the at least one nozzle 112. Alternatively, the ablation depth driver 132 (FIG. 1) may include a valve drive circuit configured to control a pressure valve 702, which may be configured as a variable pressure bleed valve.

According to embodiments, the pump 108 may be controlled to produce a lower pressure or the valve 702 may be partially opened to bleed pressure, thus producing lower pressure at the nozzle 112. Lower pressure at the nozzle 112 may produce a relatively lower velocity jet 114 selected to produce a relatively shallow etch depth $d_1$ into the workpiece 103 from the workpiece surface 202. Alternatively, the pump 108 may be controlled to produce a higher pressure or the valve 702 may be at least partially closed to reduce pressure bled from the delivery tube 110, thus producing a higher pressure at the nozzle 112. Higher pressure at the nozzle 112 may produce a relatively higher velocity jet 114 selected to produce a relatively large etch depth $d_2$ into the workpiece 103.

Figure 8:
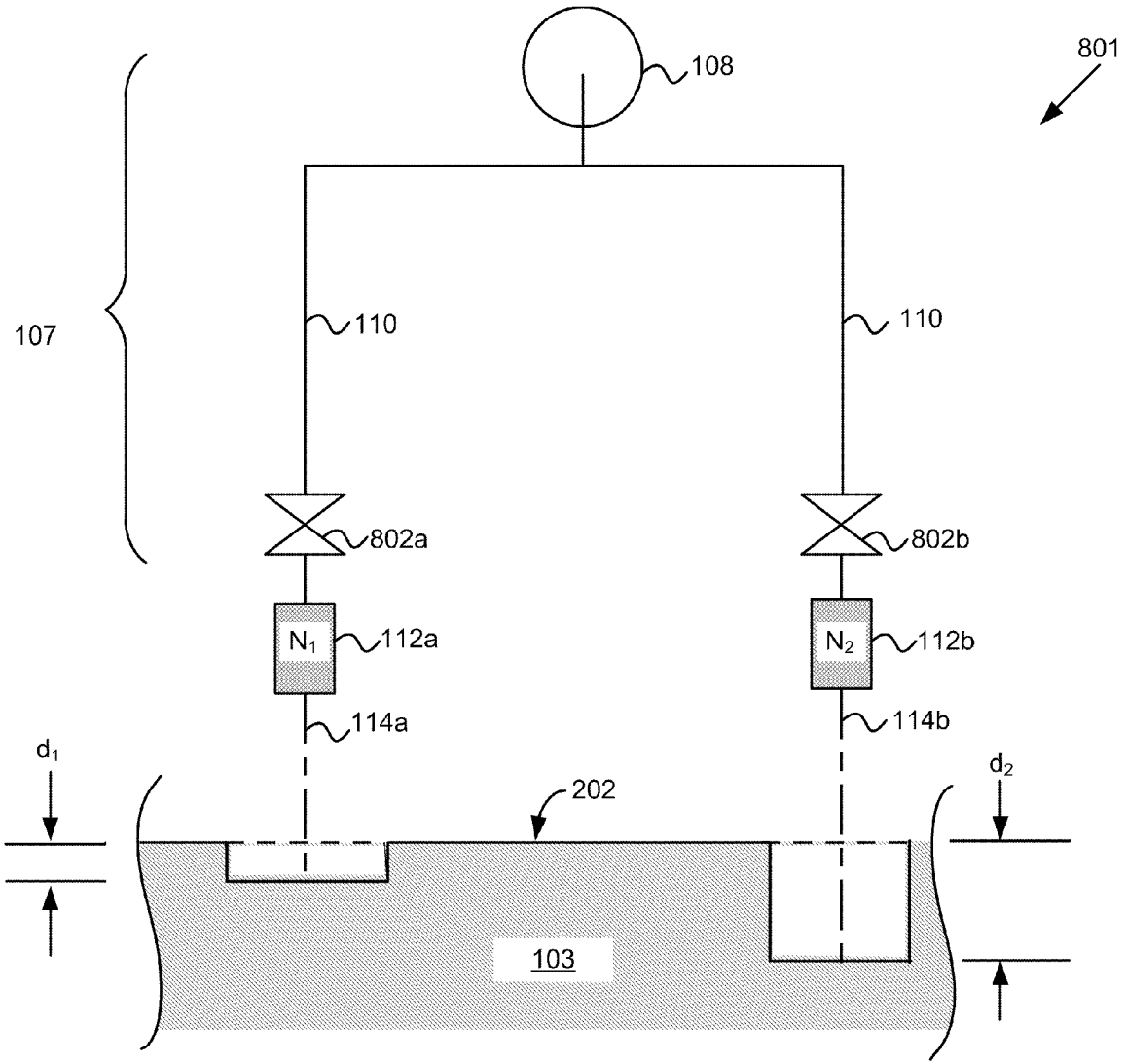
FIG. 8 is a diagram showing a fluid jet system including a plurality of nozzles $N_1$, $N_2$ configured to remove respective depths $d_1$, $d_2$ of material from a workpiece, according to an embodiment.

FIG. 8 is a diagram showing a portion of a fluid jet system 801 including a plurality of nozzles $N_1$, $N_2$ 112*a*, 112*b* configured to remove respective depths $d_1$, $d_2$ of material from a workpiece 103, according to an embodiment. A fluid delivery system 107 may include a pump 108 configured to deliver pressurized fluid to a plurality of nozzles 112*a*, 112*b* through a fluid delivery tube 110. Respective nozzle selector valves 802*a*, 802*b* may selectively couple the nozzles 112*a*, 112*b* to the pump 108. For example a first valve $N_1$ 112*a* may be configured to produce a relatively shallow ablation depth $d_1$ into the workpiece 103 from the workpiece surface 202. A second valve $N_2$ 112*b* may be configured to produce a relatively deep ablation depth $d_2$ into the workpiece.

An ablation depth driver 132 (FIG. 1) may include a nozzle selector circuit configured to select one or more nozzles 112*a*, 112*b* according to an intended ablation depth. The nozzle selector circuit may include one or more valve driver circuits configured to drive respective valves 802*a*, 802*b* to selectively couple fluid pressure to the selected nozzle 112*a*, 112*b*. According to an embodiment, a plurality of selector valves 802*a*, 802*b* may be replaced by one or more combined selector valves (not shown) configured to divert pressure to one or more of a plurality of nozzles 112*a*, 112*b*.

The nozzles $N_1$, $N_2$ 802*a*, 802*b* may be configured to output respective jets 114*a*, 114*b* configured to produce respective etch depths $d_1$, $d_2$ according to various approaches described herein. For example the first nozzle $N_1$ 112*a* may have an orifice (not shown) somewhat larger than the orifice of the second nozzle $N_2$ 112*b*, to produce a somewhat larger diameter jet 114*a*. For example, the first nozzle $N_1$ 112*a* may be placed at a somewhat greater distance from the surface 202 of the workpiece than the second nozzle $N_2$ 112*b*. For example the first nozzle $N_1$ 112*a* may receive pressurized fluid a somewhat lower pressure than the pressure of the fluid received by the second nozzle $N_2$ 112*b*. For example, the second nozzle $N_2$ 112*b* may be configured to project a fluid jet 114*b* having a somewhat higher abrasive content than the fluid jet 114*a* produced by the first nozzle $N_1$ 112*a*. For example the first nozzle $N_1$ 112*a* may project a fluid jet 114*a* at a more shallow angle toward the workpiece surface 202 than the fluid jet 114*b* projected by the second nozzle $N_2$ 112*b*.

Alternatively or additionally, plural etch depths may be produced according to how many of the plurality of nozzles $N_1$, $N_2$, 112*a*, 112*b* are selected to impinge on a given point on the workpiece 103. The plurality of nozzles $N_1$, $N_2$, 112*a*, 112*b* may thus produce additive amounts of material ablation.

Since the plurality of nozzles $N_1$, $N_2$ 112*a*, 112*b* impinge on different portions of the workpiece at a given time, the plurality of nozzles $N_1$, $N_2$ 112*a*, 112*b* are typically actuated at different times corresponding to the moment of transit across a given location on the workpiece. For example, the plurality of nozzles $N_1$, $N_2$, 112*a*, 112*b* may be configured to scan across respective rows in a scan pattern, such as the scan pattern discussed below in conjunction with FIG. 10. The ablation depth driver 132 (FIG. 1) may be configured to drive each of the plurality of nozzles $N_1$, $N_2$, 112*a*, 112*b* according to its position relative to the workpiece 103 on a given scan row.

According to an alternative embodiment, the plurality of nozzles $N_1$, $N_2$, 112*a*, 112*b* may be configured to produce substantially equal ablation depths $d_1=d_2$. Plural etch depths may be produced according to how many of the plurality of nozzles $N_1$, $N_2$, 112*a*, 112*b* are selected to impinge on a given point on the workpiece 103, wherein the etch depth provided by a given nozzle $N_1$ 112*a* is substantially equal and additive to an etch depth provided by another nozzle $N_2$ 112*b*.

Figure 9A:
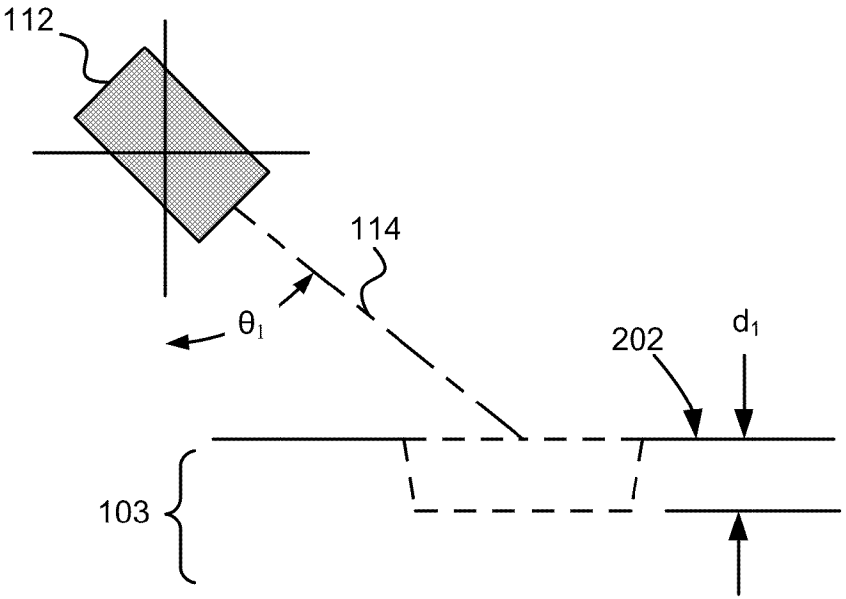
FIG. 9A is a diagram of a portion of a fluid jet system configured to remove a plurality of depths of material from a workpiece 101 by controlling a fluid jet angle relative to a workpiece, according to an embodiment.
Figure 9B:
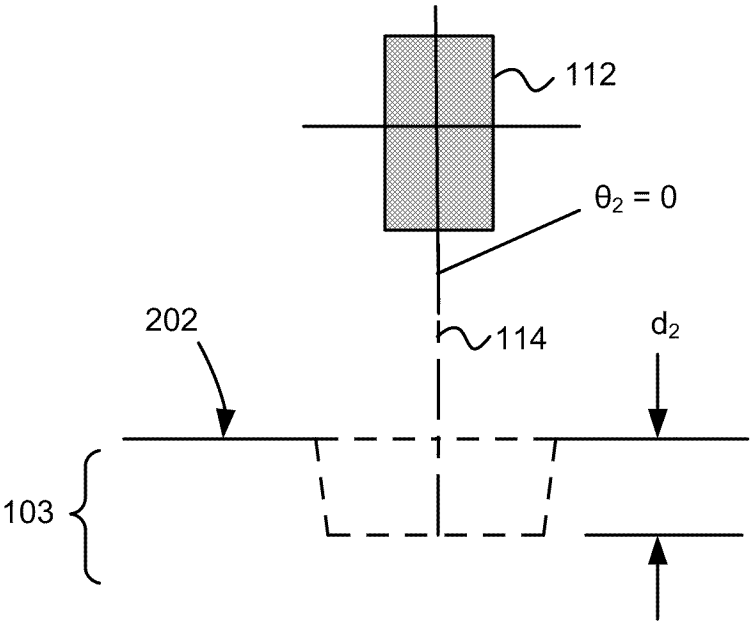
FIG. 9B illustrates the portion of a fluid jet system configured to remove a plurality of depths of material from a workpiece by controlling a fluid jet angle of FIG. 9A showing a second nozzle angle different from the first angle, according to an embodiment.

FIGS. 9A and 9B are diagrams of a portion of a fluid jet system configured to remove a plurality of depths of material from a workpiece 103 by controlling a nozzle 112 and fluid jet 114 angle θ relative to the workpiece 103, according to an embodiment. FIG. 9A illustrates a fluid jet nozzle 112 actuated to a first angle $\theta_1>0$ to project a fluid jet 114 onto a workpiece 103 surface 202 to produce a first etch depth $d_1$. FIG. 9B illustrates a fluid jet nozzle 112 actuated to a second angle different from the first angle $\theta_2=0$, corresponding to the fluid jet impinging on the surface 202 of the workpiece 103 along a substantially normal direction. The second angle $\theta_2=0$ is selected to produce a second etch depth $d_2$. Generally, a relatively shallow fluid jet 114 impingment angle $\theta_1$ may produce a relatively shallow etch depth $d_1$ and a steeper fluid jet 114 impingement angle $\theta_2<\theta_1$ may produce a relatively deep etch depth $d_2$. The ablation depth driver 132 (FIG. 1) may be configured to drive an angle actuator (not shown) to move at least one nozzle 112 to a plurality of angles relative to a surface of the workpiece 103.

Ablation depth actuation mechanisms that control the depth d of ablation into a workpiece 103 described above may optionally be used in combination. For example, a given embodiment may include both movement velocity modulation and z-axis distance modulation. The use of plural depth modulation actuators may, for example, be used to increase the maximum rate of change dA/dt or dA/dX of depth modulation, compensate for artifacts caused by a depth modulation actuator, and/or increase the range of etch depths that may be produced by the fluid jet system.

Figure 10:
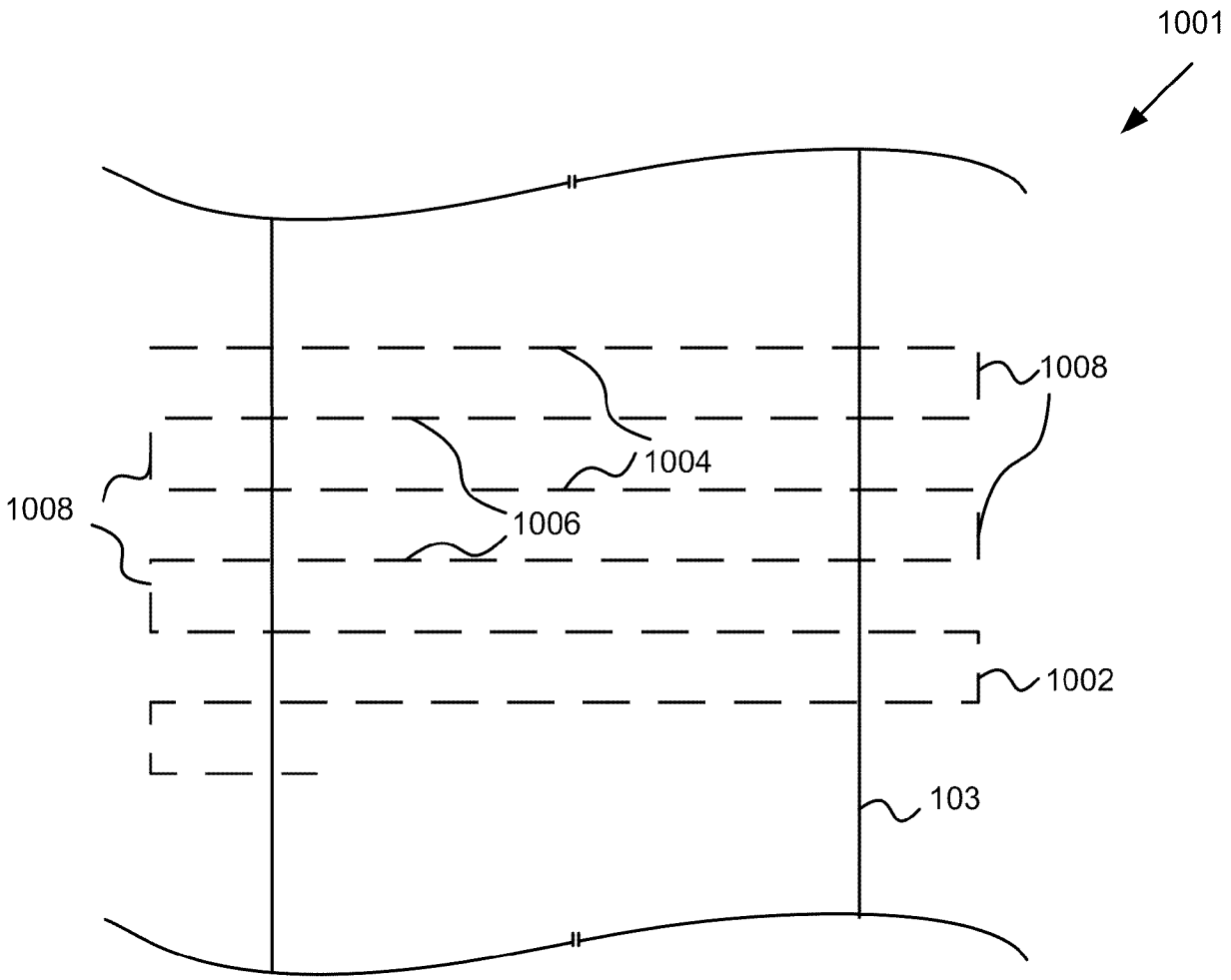
FIG. 10 is a diagram illustrating a scan pattern across a workpiece, according to an embodiment.

FIG. 10 is a diagram 1001 illustrating a scan pattern 1002 across a workpiece 103, according to an embodiment. For example the scan pattern 1002 may be substantially continuous across the workpiece 103. The ablation depth driver 132 (FIG. 1) may be configured to modulate the penetration depth of the fluid jet 114 into the workpiece 103 as the fluid jet scans across the workpiece 103 in a fluid jet scan pattern 1002. For example the fluid jet scan pattern may include at least one of a raster pattern (as illustrated), a bidirectional raster pattern (as illustrated), a Lissajous pattern, or a vector pattern. Scan lines in a scan pattern may include linear, curvilinear, and/or corner portions, according to embodiments.

A unidirectional raster pattern may include flyback portions wherein the fluid jet traverses the workpiece 103 right-to-left and etching portions wherein the fluid jet traverses the workpiece 103 left-to-right, for example. To minimize degradation of the etched image, the fluid jet 114 may be stopped during the flyback portion, the flyback portion may be made a high speed to minimize etch depth, or another ablation depth actuator may be modulated to eliminate or reduce material removed during the flyback.

Alternatively left-to-right rows 1004 may be interleaved with right-to-left rows 1006, with etching performed in both directions. A scan pattern having interleaved left-to-right rows 1004 and right-to-left rows 1006 may be referred to as a bidirectional raster pattern 1002. Typically, the image converter (e.g. included in the computer 102 or controller 106 of FIG. 1) may reverse data from the source image in the right-to-left rows 1006 relative to the left-to-right rows 1004 to maintain the proper orientation of etched pixels. Alternatively, the controller 106 may reverse the order of tool command output in the right-to-left rows 1006 relative to the left-to-right rows 1004 to maintain the proper orientation of etched pixels. Such reversal of alternating rows of pixels may be performed in the image conversion step 1104 of the method describe below in conjunction with FIG. 11.

Figure 14:
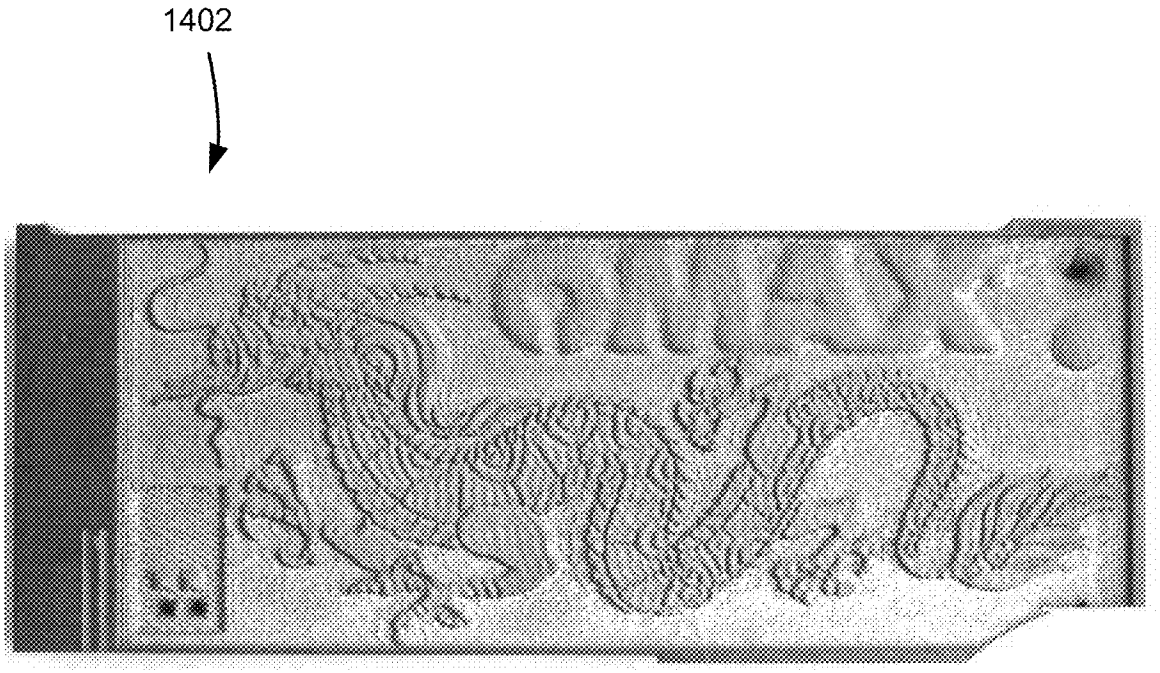
FIG. 14 is a photograph of an etched part made of mild steel corresponding to the image of FIG. 12 and produced by the fluid jet system corresponding to FIG. 1, according to an embodiment.

The ends of the scan rows 1004, 1006 may be positioned off the edges of the workpiece 103, as illustrated, or alternatively may occur on the surface of the workpiece 103, in a scan pattern that is substantially surrounded by unetched surface 202 (FIG. 2) of the workpiece 103. For example, the etched workpiece 1402 shown in FIG. 14 is an example of a workpiece that was etched using a bidirectional raster pattern (with scan speed depth modulation) that did not fall off the edge of the workpiece 103.

According to an embodiment, the ends 1008 of the rows 1004, 1006 of the scan pattern 1002 may be substantially squared-off as illustrated, or may be rounded. During transition through the ends 1008, pixels may be interpolated to maintain patency of the image.

Typically, a fluid jet apparatus 102 (FIG. 1) may include at least a two axis position actuator 116 characterized by a high-inertia axis and a low inertia axis. Typically, the low inertia axis may correspond to a y-axis transit of the at least one nozzle 112 across a width of the workpiece support system 118, and the high inertia axis may correspond to an x-axis transit of a carriage that supports the y-axis actuator and the nozzle 112 along the length of the workpiece support system 118. According to an embodiment, the scan pattern 1002 may be oriented such that a fast scan axis corresponding to rows 1004, 1006 lies parallel to the low inertia axis of the fluid jet apparatus 102 and a slow scan axis corresponding to the vertical transitions 1008 between the rows 1004, 1006 lies parallel to the high inertia axis of the fluid jet apparatus 102.

As described above, some fluid jet actuation approaches may include inertial limitations such as maximum acceleration, deceleration, speed, and/or jerk limits corresponding to mechanism limits. Typically, such limits are higher along the low inertia axis. By driving the at least one nozzle 112 in a pattern 1002 including fast scan rows 1004, 1005 parallel to the actuator axis having relatively low inertia, the etched pattern may be modulated at a higher rate compared to driving along a fast scan axis parallel to the actuator axis having relatively high inertia. According to an embodiment including nozzle velocity modulation across the scan pattern 1002, nozzle velocities between about 2 inches per minute and 25 inches per minute were used.

Figure 11:
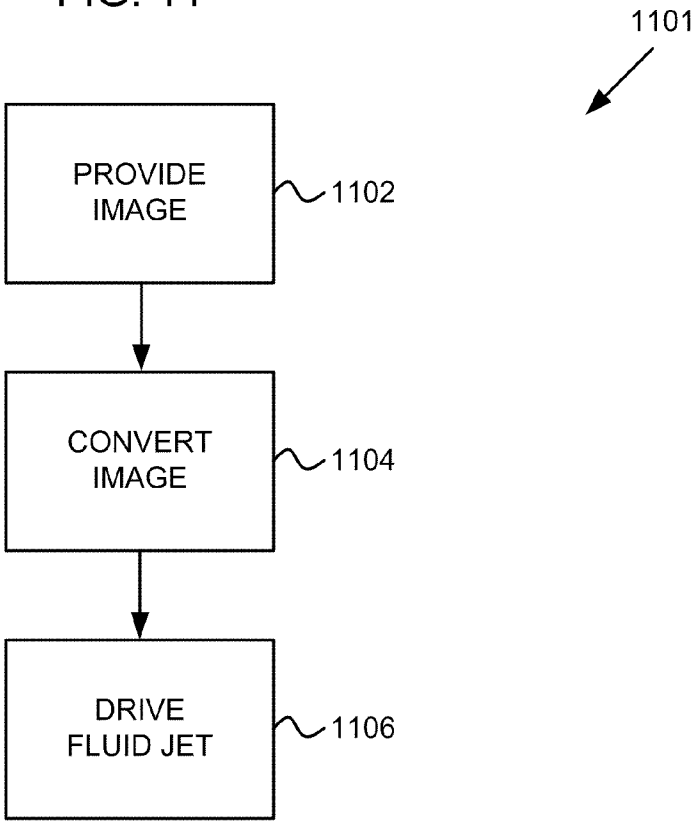
FIG. 11 is a flow chart illustrating a process for producing a part having a relief image etched thereinto, according to an embodiment.

FIG. 11 is a flow chart illustrating a process 1101 for producing a part having a relief image etched thereinto, according to an embodiment. Beginning in step 1102, an image is provided by a computing apparatus including a microprocessor and memory. According to an embodiment the computing apparatus may correspond to a computer 104 or a controller 106 of a fluid jet apparatus 102, shown in FIG. 1. Providing an image may include, for example, generating an image, reading an image from a storage device, or receiving an image from an interface such as from a camera or network. According to embodiments, providing an image may include altering an image. For example, grayscale, color, transparency, layer, or height information may be inverted, flipped or mirrored, expanded, shrunk, zoomed or otherwise altered or filtered.

Proceeding to step 1104, the image is converted to tool commands. For example, converting the image to tool commands may include selecting at least relative depths as a function of at least one of grayscale, colors, brightness, transparency, layer, or height information in the image. Converting the image to tool commands may include selecting at least one control variable A value according to a model, an algorithm, or a look-up table including information that relates depth d to control values A, such as according to illustrative relationships 302, 304, 306 shown in FIG. 3. Selecting at least one control variable A value may include selecting between relationships for different materials and/or machine settings.

Step 1104 may include image conversion corresponding to driving one or more fluid jet ablation depth modulation embodiments, for example the embodiments shown in FIGS. 2A, B, C through 8. For an embodiment using jet movement velocity corresponding to FIGS. 2A through 2C, for example, step 1104 may include the process:

1) Read each pixel, assign velocity V corresponding to grayscale value:

Velocity=GrayscaleValue*Scaler+Offset;

where Scaler and Offset scale the velocity at each point, so that one may speed up or slow down the entire process to control the overall etch depth. The Scaler may be set such that the maximum velocity of a machine 102 is never violated. The value or function used for Scaler and/or Offset selection may be varied according to process considerations such as user preference, workpiece material or structural characteristics, a cutting model of the etching process, or experimental results.

In the above equation, Offset may set the lowest speed at which the one or more nozzles will be translated. Scaler may determine the "contrast" of the final image by setting the range of speeds and top speed.

2) Determine axis with minimum dV/dX, where X is pixel spacing
3) Determine if image size allows rotation of axes
4) (Optional) Rotate the image as necessary to position minimum acceleration axis parallel with low inertia fluid jet axis.

The image may be rotated or alternatively the velocity matrix may be read in a different sequence when outputting a command file.

5) Modify values of V as needed to provide velocity ramping to comply with acceleration limits
6) Output tool command file According to alternative embodiments, the process of step 1104 may calculate one or more values A, A', etc., wherein A is a control variable selected to control a fluid jet ablation depth. For example A may include two or more jet translation velocities $v_1$, $v_2$, $V_3$; two or more distances $z_1$, $z_2$ between at least one nozzle 112 and the surface 202 of the part; a jet shape 502 at or below the surface 202; an amount of abrasive 602 entrained in the jet 114; a pressure delivered to the at least one nozzle 112 by a fluid supply system 107; and/or selection from among a plurality of nozzles $N_1$ 112*a*, $N_2$ 112*b*.

For embodiments including two or more jet translation velocities $v_1$, $v_2$, $V_3$, or other embodiments the of control variable A, the process of step 1104 may be modified to suit an engineer's preferences. For example, in:

A=GrayscaleValue*Scaler+Offset.

the scaler may be substituted with a function selected to provide a desired aesthetic relationship between an etched part and the corresponding image. For example, an etch depth d may vary with A according to a linear or non-linear relationship such as illustrative relationships represented by the curves 302, 304, and 306 of FIG. 3. Offset may optionally be embodied as apparatus 102 compensation. The scaler or alternative function may be determined responsive to apparatus calibration values.

For example, the calculation of dA/dX may be substituted for:

dV/dX, where X is pixel spacing

According to an embodiment, process portion 6 may include modifying the speed v to meet maximum acceleration dV/dX and/or maximum jerk $d^2V/dX^2$.

Alternatively, process portions 2, 3, 4, and/or 5 may be omitted. For example, systems having substantially no constraint or a very high limit with respect of rates of change of one or more control variables A may omit some or all of step 1104 process portions 2-5.

Proceeding to step 1106 (which may be embodied as step 7 of the process 1104), the fluid jet apparatus 102 may be driven to etch a part according to approaches including embodiments described above.

Figure 12:
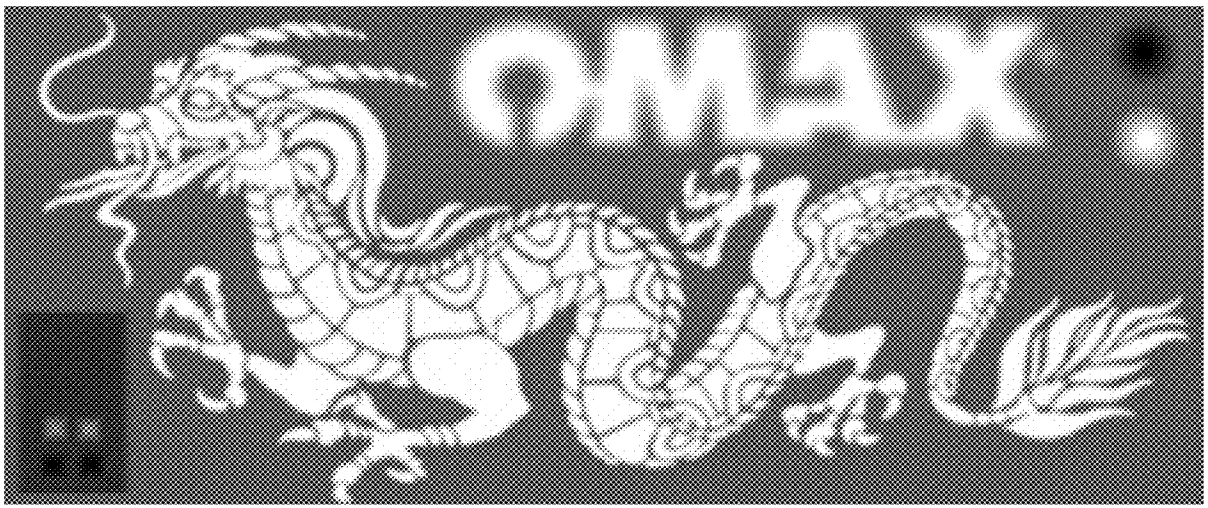
FIG. 12 is a depiction of an image file including a bitmap with grayscale used to drive fluid jet ablation depths, according to an embodiment.
Figure 13:
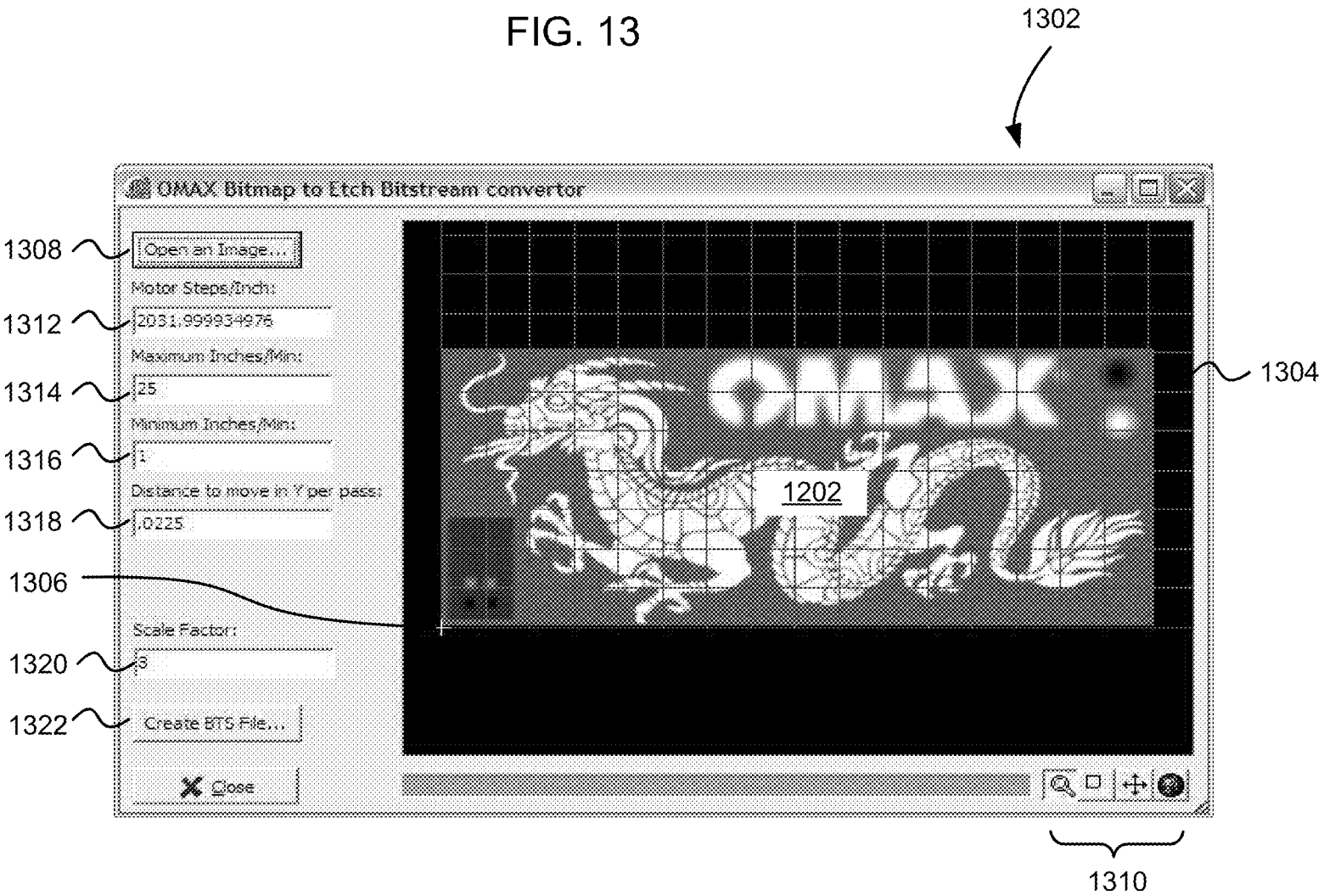
FIG. 13 is a screenshot of an application configured to convert the bitmap of FIG. 12 into tool commands, according to an embodiment.

FIG. 12 is a depiction of an image file 1202 including a bitmap with grayscale pixel data used to drive fluid jet ablation depths, according to an embodiment. FIG. 13 is a screenshot 1302 of an application configured to convert the bitmap of FIG. 12 into tool commands, according to an embodiment. The application includes a user interface module configured to provide a display window 1304 showing the image 1202 superimposed over gridlines including an origin 1306. Typically, the origin may be set to correspond to a particular location relative to the workpiece support system 118 (FIG. 1). The image may be loaded into the application by receiving a computer pointing device click on an "Open an Image . . . " button 1308. The button 1308 may open a dialog box where the user may specify the location of an existing image or may browse among available images.

The user interface includes image navigation controls 1310 configured to select a context for pointing device commands. The user may set the position of the image 1202 relative to the origin 1306 and the gridlines using the image navigation controls 1310 and a computer pointing device.

A number of fluid jet apparatus 102 (FIG. 1) settings are displayed along the left side of the window 1302. A "Motor Steps/inch" box 1312 displays a characteristic number of motors steps required to move the position actuator 116 a given distance. Typically, the "Motor Steps/inch" box 1312 is a physical attribute of a given model of fluid jet apparatus 102. A "Maximum Inches/Min" box 1314 may list the maximum translation speed in inches per minute that the given model of fluid jet apparatus 102 will provide, or alternatively may be set lower than the maximum to increase the minimum etch depth. The "Maximum Inches/Min" box 1314 is indicative of a constraint of a fluid jet apparatus 102 used to produce an etched part that is typically not present in other etching technologies. According to embodiments, it may not be possible to turn the fluid jet 114 off easily. Hence, ablation into a workpiece 103 is continuous, rather than discontinuous, such as may be the case with a laser ablation system. The "Maximum Inches/Min" box 1314 provides an indication of the minimum etch depth that may be produced anywhere on the workpiece 103. Thus, it may not be possible to include areas with zero ablation. The inventor has found that it is still possible to produce high quality etched parts despite this constraint of fluid jet technology.

A "Minimum Inches/Min" box 1316 may be used to input the slowest scan speed at which the fluid jet nozzle 112 will be scanned across the workpiece 103. The "Minimum Inches/Min" box 1316 may be set as a function of machine etching speed, and/or workpiece material properties or thickness. For example, the "Minimum Inches/Min" 1316 may be set such that an etched image does not include any depth that extends all the way through the workpiece 103 or which results in an unacceptably weak part. Alternatively, the "Minimum Inches/Min" 1316 may be set to cut through the workpiece 103 and the image 1202 may be compressed or selectively compressed such that the image itself does not include pixels that penetrate through the workpiece 103. This may be used, for example to etch and cut out etched parts in a single operation.

A "Distance to move in Y per pass" box 1318 may be used to select the vertical spacing between scan rows 1004, 1006 in a scan pattern 1002 (FIG. 10). A larger value in box 1318 may produce a part that may be etched more quickly. A smaller value in box 1318 may produce a more finely detailed part. For applications where the "Minimum Inches/Min" 1316 is not set automatically, it may be advantageous to increase the "Minimum Inches/Min" 1316 for very small values of "Distance to move in Y per pass" 1318, owing to possible overlap of jet impingement and hence additive ablation effects between rows 1004, 1006.

A "Scale Factor" box 1320 may be used to enlarge or reduce the size of the etched part. Once the user is satisfied with the machine settings, the selected image, and the position of the image, the user may press the "Create BTS File" button 1322 to convert the image to tool commands. The Create BTS File" button 1322 may create a bitstream file specific to output to a particular manufacturer's fluid jet system 101 (FIG. 1). For example, a "BTS file" is particular to fluid jet cutters manufactured by OMAX™ Corporation, of Kent, Wash. Optionally, other file formats may be substituted for BTS. Optionally, the application may provide output options for a plurality of file formats and fluid jet cutting systems. Optionally, the application may include commands to start the etching process.

FIG. 14 is a photograph of an etched part 1402 made of mild steel including an etched image corresponding to the image 1202 of FIG. 12 and produced by the fluid jet system 101 corresponding to FIG. 1, according to an embodiment. The etched part 1402 was made at speeds from 2 inches per minute to 25 inches per minute. Part took 36 minutes to make using an OMAX Mini-Jet nozzle at 30,000 PSI pressure, and a gap of 0.015" between each scan-line of the bitmap.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A fluid jet system, comprising:

a plurality of nozzles configured to emit at least one fluid jet toward a workpiece;

a position actuator configured to move at least one nozzle of the plurality of nozzles relative to the workpiece;

a controller including a ablation depth driver, the ablation depth driver being configured to modulate a penetration depth of the fluid jet into the workpiece;

a computer operatively coupled to the controller and configured to convert an image to tool commands; and a data interface operatively coupled to the controller and configured to receive data including the tool commands from the computer;

wherein the ablation depth driver is configured to modulate the fluid jet penetration depth corresponding to the tool commands;

wherein the computer includes a program configured to select at least relative depths as a function of at least one of grayscale and color information in the image;

wherein the ablation depth driver includes a nozzle selector circuit configured to select one or more nozzles according to an intended ablation depth; and wherein the nozzle selector circuit includes a circuit configured to select a first nozzle to penetrate a first depth into the workpiece and a second nozzle to penetrate to a second depth different than the first depth.

2. The fluid jet system of claim 1, wherein the ablation depth driver is configured to dynamically modulate the penetration depth of the fluid jet into the workpiece synchronously with movement of the at least one nozzle relative to the workpiece.

3. The fluid jet system of claim 1, wherein the position actuator is configured to scan the at least one nozzle relative to the workpiece in a pattern including a fast scan axis corresponding to relatively low inertia movement of the at least one nozzle across a width of the workpiece or a relatively low inertia movement of the workpiece past the at least one nozzle and a slow scan axis corresponding to relatively high inertia movement of the at least one nozzle along a length of the workpiece or relatively high inertia movement of the workpiece past the at least one nozzle.

4. The fluid jet system of claim 1, wherein the ablation depth driver is configured to modulate a velocity at which the position actuator moves the at least one nozzle.

5. The fluid jet system of claim 4, wherein the at least one nozzle is driven at a relatively high velocity at locations of a scan pattern corresponding to relatively little ablation of the workpiece and at a relatively low velocity at locations of a scan pattern corresponding to relatively large ablation of the workpiece.

6. The fluid jet system of claim 1, further comprising:

a Z-axis actuator configured to move the at least one nozzle to a plurality of distances from a surface of the workpiece; and wherein the ablation depth driver includes a Z-axis actuator driver circuit configured to modulate the distance of the at least one nozzle from the surface of the workpiece.

7. The fluid jet system of claim 1, further comprising:

an abrasive supply system configured to provide abrasive to the fluid jet; and wherein the ablation depth driver includes an abrasive flow actuator circuit configured to modulate an amount of abrasive entrained in the fluid jet.

8. The fluid jet system of claim 1, further comprising:

a fluid delivery system configured to provide pressurized fluid to the at least one nozzle; and wherein the ablation depth driver is configured to modulate the pressure of the fluid provided to the at least one nozzle.

9. The fluid jet system of claim 1, wherein the circuit configured to select a first nozzle to penetrate a first depth into the workpiece and a second nozzle to penetrate to a second depth different than the first depth includes a circuit configured to select a first nozzle for etching and a second nozzle for cutting the workpiece.

10. A fluid jet system, comprising:

a nozzle configured to emit a fluid jet toward a workpiece;

a position actuator configured to move the nozzle relative to the workpiece; and a controller including an ablation depth driver, the ablation depth driver being configured, responsive to an image representing a desired object to be formed, to control operating parameters of the fluid jet to modulate a penetration depth of the fluid jet into the workpiece as a function of brightness information in the image, a scaling factor, and an offset value.

11. The fluid jet system of claim 10, further comprising a position actuator configured to rotate the workpiece on an axis substantially perpendicular to the fluid jet.

12. The fluid jet system of claim 11, wherein the workpiece is substantially cylindrical and wherein the ablation depth driver is configured to etch an image partly or completely around the circumference of the workpiece.

13. The fluid jet system of claim 10, wherein the ablation depth driver is configured to control operating parameters of the fluid jet to modulate a penetration depth of the fluid jet to etch into the workpiece or to cut through the workpiece.

14. The fluid jet system of claim 10, wherein the ablation depth driver is configured to dynamically modulate the penetration depth of the fluid jet into the workpiece synchronously with movement of the nozzle relative to the workpiece.

15. The fluid jet system of claim 10, wherein the position actuator is configured to scan the nozzle relative to the workpiece in a pattern including a fast scan axis corresponding to relatively low inertia movement of the at least one nozzle across a width of the workpiece or a relatively low inertia movement of the workpiece past the nozzle and a slow scan axis corresponding to relatively high inertia movement of the nozzle along a length of the workpiece or relatively high inertia movement of the workpiece past the nozzle.

16. The fluid jet system of claim 10, wherein the ablation depth driver is configured to modulate a velocity at which the position actuator moves the nozzle relative to the workpiece.

17. The fluid jet system of claim 16, wherein the position actuator moves the nozzle relative to the workpiece at a relatively high velocity at locations corresponding to relatively little ablation of the workpiece and at a relatively low velocity at locations corresponding to relatively large ablation of the workpiece.

18. The fluid jet system of claim 10, further comprising:

a Z-axis actuator configured to move the nozzle to a plurality of distances from a surface of the workpiece; and wherein the ablation depth driver includes a Z-axis actuator driver circuit configured to modulate the distance of the nozzle from the surface of the workpiece.

19. The fluid jet system of claim 10, further comprising:

a fluid jet diameter actuator configured to select a plurality of fluid jet diameters to impinge on the workpiece; and wherein the ablation depth driver is configured to modulate the diameter of the fluid jet impinging on the workpiece.

20. The fluid jet system of claim 10, further comprising:

an abrasive supply system configured to provide abrasive to the fluid jet; and wherein the ablation depth driver includes an abrasive flow actuator circuit configured to modulate an amount of abrasive entrained in the fluid jet.

21. The fluid jet system of claim 10, further comprising:

a fluid delivery system configured to provide pressurized fluid to the nozzle; and wherein the ablation depth driver is configured to modulate the pressure of the fluid provided to the nozzle.

22. The fluid jet system of claim 21, wherein the fluid delivery system includes a pressure valve; and wherein the ablation depth driver includes a valve drive circuit configured to control the pressure valve.

23. The fluid jet system of claim 21, wherein the fluid delivery system includes a pump; and wherein the ablation depth driver includes a pump drive circuit configured to control the pump.

24. The fluid jet system of claim 10, further comprising:

an angle actuator configured to move the nozzle to a plurality of angles relative to a surface of the workpiece; and wherein the ablation depth driver includes an angle actuator driver circuit configured to modulate the angle of the nozzle relative to the surface of the workpiece.

25. The fluid jet system of claim 10, further comprising an actuator configured to control the shape of the fluid jet.

26. The fluid jet system of claim 10, wherein the ablation depth driver includes at least one of software, firmware, or hardware instructions or electrical circuitry configured to provide an output signal or data to control an ablation depth.

27. The fluid jet system of claim 10, wherein the position actuator is configured to move the workpiece past the nozzle.

28. The fluid jet system of claim 10, wherein the ablation depth driver is configured to control an operating parameter of the fluid jet to modulate a penetration depth of the fluid jet into the workpiece based on a non-linear relationship between depth and the operating parameter.

29. The fluid jet system of claim 10, wherein the ablation depth driver is further configured to modulate a penetration depth of the fluid jet into the workpiece as a function of at least one of color, transparency, layer, or height information in the image.

30. A method in a fluid jet system for etching three-dimensional relief features, the system having a nozzle configured to emit a fluid jet toward a workpiece, a controller configured to control operating parameters of the fluid jet, and a computer operatively coupled to the controller, the method comprising:

receiving, by the computer, an image containing grayscale or color information;

selecting, by the computer, a plurality of depths based on the grayscale or color information in the image, a scaling factor, and an offset value;

determining, by the computer, operating parameters of the fluid jet to etch the workpiece according to the selected plurality of depths;

moving, by the controller, the nozzle relative to the workpiece; and modulating, by the controller, a penetration depth of the fluid jet into the workpiece according to the determined operating parameters as the nozzle moves relative to the workpiece.

31. The method of claim 30, wherein selecting a plurality of depths includes compressing the image.

32. The method of claim 30, wherein selecting a plurality of depths includes selecting a first depth for etching and a second depth for cutting the workpiece.

33. The method of claim 30, wherein determining operating parameters of the fluid jet includes basing the determination of an operating parameter for a selected depth on a non-linear relationship between depths and the operating parameter.

34. The method of claim 30, wherein determining operating parameters of the fluid jet includes:

identifying a low inertia axis of the fluid jet system;

determining a minimum acceleration axis of movement to etch the workpiece according to the selected plurality of depths; and rotating the image to position the determined minimum acceleration axis parallel with the identified low inertia fluid jet system axis.

35. The method of claim 30, wherein moving the nozzle relative to the workpiece includes moving the nozzle and maintaining the workpiece stationary.

36. The method of claim 35, wherein moving the nozzle relative to the workpiece includes moving the nozzle at speeds from approximately 2 inches per minute to approximately 25 inches per minute.

37. A fluid jet system, comprising:

a plurality of nozzles configured to emit at least one fluid jet toward a workpiece;

a position actuator configured to move at least one nozzle of the plurality of nozzles relative to the workpiece;

a controller including a ablation depth driver, the ablation depth driver being configured to modulate a penetration depth of the fluid jet into the workpiece;

a computer operatively coupled to the controller and configured to convert an image to tool commands; and a data interface operatively coupled to the controller and configured to receive data including the tool commands from the computer;

wherein the ablation depth driver is configured to modulate the fluid jet penetration depth corresponding to the tool commands;

wherein the computer includes a program configured to select at least relative depths as a function of at least one of grayscale and color information in the image;

wherein the ablation depth driver includes a nozzle selector circuit configured to select one or more nozzles according to an intended ablation depth; and wherein the nozzle selector circuit includes a circuit configured to select more than one nozzle to impinge on a given point on the workpiece.

38. The fluid jet system of claim 37, wherein the ablation depth driver is configured to modulate a velocity at which the position actuator moves the selected nozzles.

39. The fluid jet system of claim 38, wherein the selected nozzles are driven at a relatively high velocity at locations of a scan pattern corresponding to relatively little ablation of the workpiece and at a relatively low velocity at locations of a scan pattern corresponding to relatively large ablation of the workpiece.

40. The fluid jet system of claim 37, further comprising:

an angle actuator configured to move the at least one nozzle to a plurality of angles relative to a surface of the workpiece; and wherein the ablation depth driver includes an angle actuator driver circuit configured to modulate the angle of the at least one nozzle relative to the surface of the workpiece.

* * * * *